US005479327A

United States Patent [19]

Chen

[11] Patent Number: 5,479,327

[45] Date of Patent: Dec. 26, 1995

[54] LIGHTING FIXTURE FOR AQUARIUMS

[76] Inventor: Kuo L. Chen, No. 159, Tung Hu Rd., Nei Hu Chu, Taipei, Taiwan

[21] Appl. No.: 328,172

[22] Filed: Oct. 21, 1994

[51] Int. Cl.[6] ..... F21S 3/00

[52] U.S. Cl. ..... 362/222; 362/218; 362/225; 362/267

[58] Field of Search ..... 362/217, 218, 362/221, 222, 223, 224, 225, 260, 267

[56] References Cited

U.S. PATENT DOCUMENTS

| | | | |
|---|---|---|---|
| 3,836,765 | 9/1974 | Ritzow et al. | 362/223 |
| 3,860,829 | 1/1975 | Fabbri | 362/218 |
| 4,342,072 | 7/1982 | Guritz | 362/222 |
| 4,858,087 | 8/1989 | Hartshorn | 362/225 |
| 5,089,940 | 2/1992 | Lanzarone et al. | 362/218 |
| 5,113,328 | 5/1992 | Foster et al. | 362/223 |

FOREIGN PATENT DOCUMENTS

| | | | |
|---|---|---|---|
| 0391493 | 10/1990 | European Pat. Off. | 362/217 |

*Primary Examiner*—Ira S. Lazarus

*Assistant Examiner*—Alan B. Cariaso

*Attorney, Agent, or Firm*—Pro-Techtor International

[57] ABSTRACT

A lighting fixture including an elongated housing defining a downward open space of a uniform cross section shaped like a truncated cone and having two longitudinal upper tracks and two longitudinal lower tracks, a transparent, water-proof bottom board fastened to the lower track of the housing, a flat, elongated lamp holder made of hollow structure having two flat, longitudinal, lateral bearing walls fastened to the upper tracks for holding a respective lamp tube below, a flat, longitudinal, intermediate bearing wall for holding a lamp tube, and two opposite sloping walls bilaterally connected between the lateral bearing walls and the intermediate bearing wall, two end caps fastened to the housing at two opposite ends, and water sealing jackets fastened to two opposite ends of each lamp tube, wherein the lamp holder can be set in a first position with the intermediate bearing wall disposed at a higher elevation than the lateral bearing walls to hold a single lamp tube, or turned upside down and set in a second position with the lateral bearing walls disposed at a higher elevation than the intermediate bearing wall to hold two lamp tubes.

4 Claims, 4 Drawing Sheets

LIGHTING FIXTURE FOR AQUARIUMS

BACKGROUND OF THE INVENTION

The present invention relates to lighting fixtures, and relates more particularly to a lighting fixture for use in an aquarium that can be alternatively arranged to hold a single lamp tube or two lamp tubes.

Various lighting fixtures are well known and intensively used in aquariums. FIGS. 1 and 2 show a box-like lighting fixture for aquariums according to the prior art. This structure of box-like lighting fixture comprises a substantially rectangular, box-like housing A defining an upper chamber A1, which receives the electric apparatus, and a lower chamber A2, which receives two lamp tubes B. The lower chamber A2 is an open chamber. When lamp tubes B are installed, the lower chamber A2 is closed by a transparent cover board, which is fastened to the housing A by screws (not shown). However, this structure of box-like lighting fixture has various drawbacks. Because the box-like housing A is made from plastics through an injection molding process and has no air vents for the dissipation of heat, it will become aged and fragile quickly. Because the heads of the screws are disposed outside the housing A, they will soon rust away. Another drawback of this structure of lighting fixture is its poor water-proof effect. When in use, moisture tends to get into the housing A, causing an electric leakage. Because the transparent cover board constantly receives the radiation of the lamp tubes B, its material property will soon be changed and become fragile. When the material property of the transparent cover board is changed, it may affect the quality of water. Still another drawback of this structure of lighting fixture is that the lower chamber A2 is designed specifically for holding one or two lamp tubes, and the consumers do not have the option of taking one or two lamp tubes. Still another drawback of this structure of lighting fixture is its poor light reflecting effect. The peripheral wall of the lower chamber A2 of the housing A is covered with a white object (white paper board, white coating, etc.,). Because the white object fades and wears with use quickly, its light reflecting effect becomes worse. Furthermore, because the lower chamber A2 is made of rectangular shape, the projecting angle of light is limited by the two opposite vertical side walls of the lower chamber A2 (see FIG. 2). In order to provide sufficient intensity of light, more sets of lighting fixtures may be required. However, when more lighting fixtures are installed, the consumption of electric power will be relatively increased.

SUMMARY OF THE INVENTION

The present invention has been accomplished to provide a lighting fixture which eliminates the aforesaid drawbacks.

According to one aspect of the present invention, the lighting fixture comprises a housing covered with a transparent bottom board and two end caps, and a lamp holder disposed inside the housing to hold one lamp tube or two lamp tubes. The lamp holder is made of hollow structure having two flat, longitudinal, lateral bearing walls fitted into two upper tracks inside the housing, a flat longitudinal, intermediate bearing wall, and two opposite sloping walls bilaterally connected between the lateral bearing walls and the intermediate bearing wall. When the lamp holder is fastened to the housing with the intermediate bearing wall disposed at a higher elevation than the lateral bearing walls, a single lamp tube can be mounted on the intermediate bearing wall and disposed between the sloping walls. When the lamp holder is fastened to the housing with the intermediate bearing wall disposed at a lower elevation than the lateral bearing walls, two lamp tubes can be mounted on the lateral bearing walls and disposed at a lower elevation than the lateral bearing walls.

According to another aspect of the present invention, the housing has two lower traces bilaterally disposed on the inside for mounting the transparent bottom board. By fitting the two opposite long sides of the transparent bottom board into the lower tracks, the transparent bottom board is fastened to the housing without the use of any fastening elements.

According to still another aspect of the present invention, the housing has a uniform cross section shaped like a truncated cone, defining a downward open space in width gradually bigger toward the bottom, therefore the projecting angle of light is relatively increased.

According to still another aspect of the present invention, water sealing jackets are provided for mounting on two opposite ends of each lamp tube being fastened to the lamp holder to prevent the leakage of electricity. Each water sealing jacket has a receptacle at one end for receiving a respective lamp tube, and an electric socket at an opposite end for receiving the contact pins of the respective lamp tube and connecting them to an electric power circuit.

According to still another aspect of the present invention, the space defined within the housing and the bottom board is divided by the lamp holder into an upper chamber for holding electric apparatus, and a lower chamber, and the housing has vent holes at the top for letting heat to be quickly carried away from the upper chamber.

DETAILED DESCRIPTION OF THE PREFERRED EMBODIMENT

Figure 1:
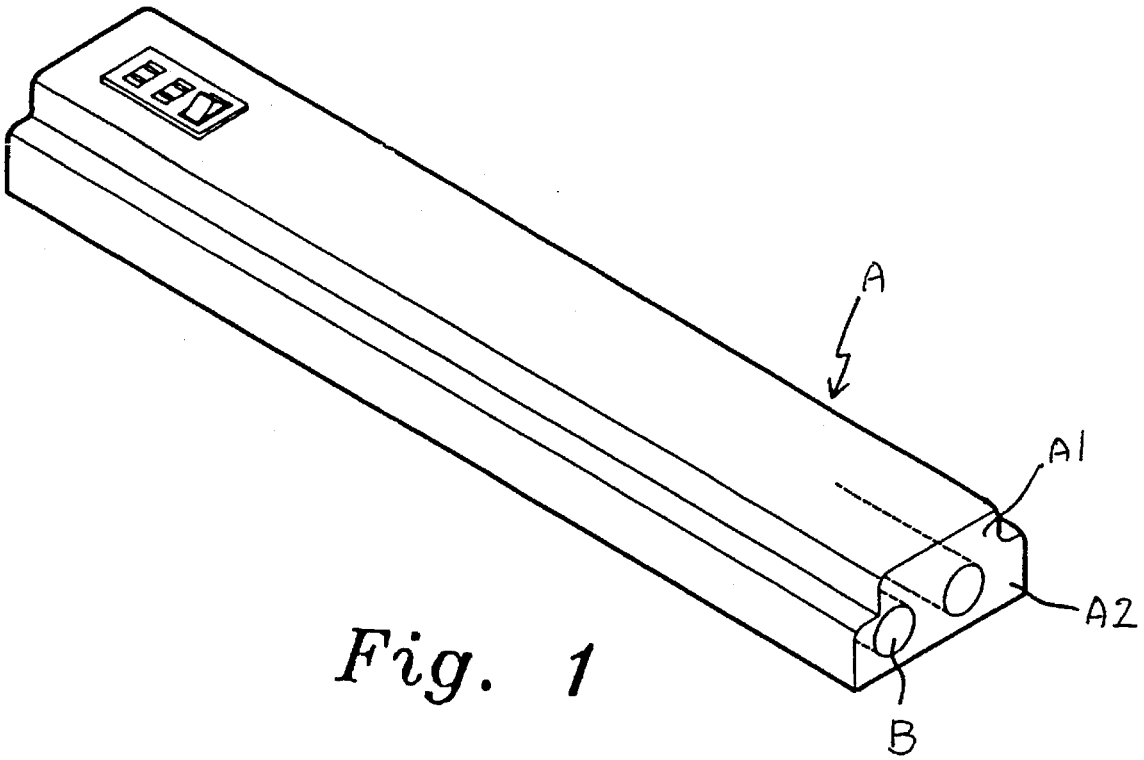
FIG. 1 shows a lighting fixture for aquariums according to the prior art.
Figure 2:
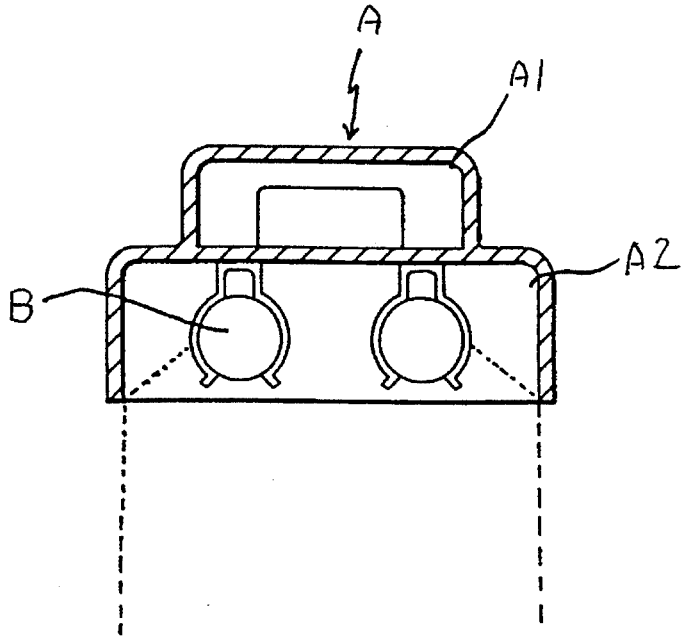
FIG. 2 is a cross sectional view of the lighting fixture shown in FIG. 1, showing the reflection of light.
Figure 3:
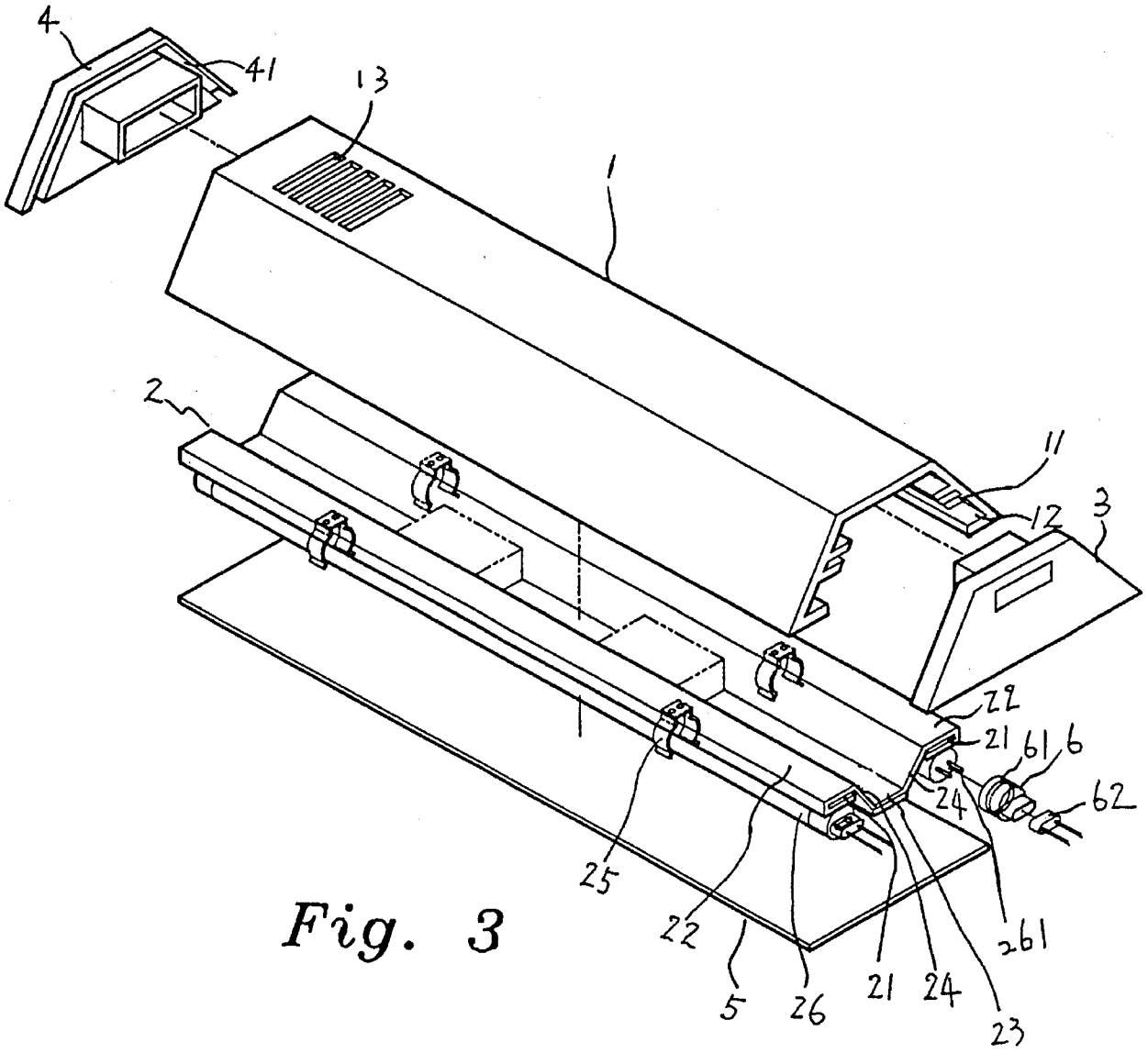
FIG. 3 is an exploded view of a lighting fixture for aquariums according to the present invention.

Referring to FIG. 3, a lighting fixture for use in an aquarium in accordance with the present invention is generally comprised of an elongated housing 1, a lamp holder 2, two end caps 3 and 4, a transparent water-proof bottom board 5, and a plurality of water sealing jackets 6.

Figure 4:
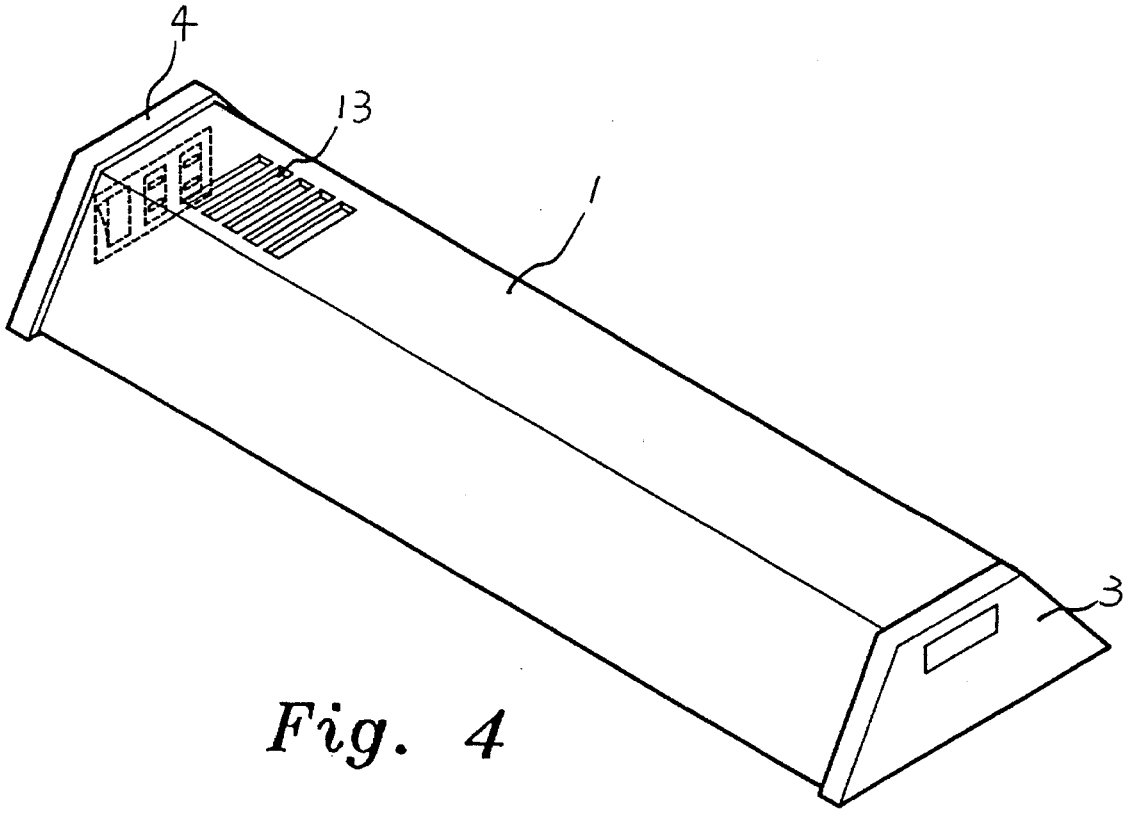
FIG. 4 shows the lighting fixture of FIG. 3 assembled.

Referring to FIG. 4 and FIG. 3 again, the housing 1 has a uniform cross section shaped like a truncated cone, defining a downward open space in width gradually bigger toward the bottom, having two longitudinal upper tracks 11 and two longitudinal lower tracks 12 bilaterally disposed on the inside at different elevations and vent holes 13 at the top. The transparent water-proof bottom board 5 is fastened to the longitudinal lower tracks 12. The end caps 3 and 4 have a respective recessed coupling portion 31 (not shown) or 41 respectively coupled to the two opposite ends of the housing 1. When the end caps 3 and 4 are fastened to the two opposite ends of the housing 1, the housing 1, the end caps 3 and 4 and the bottom board 5 define an enclosed space, which receives the lamp holder 2. The lamp holder 2 is made of hollow structure 21, comprised of two flat, longitudinal, lateral bearing walls 22, a flat, longitudinal, intermediate bearing wall 23, and two opposite sloping walls 24 bilaterally connected between the lateral bearing walls 22 and the intermediate bearing wall 23. By fitting the lateral bearing walls 22 into the longitudinal upper tracks 11, the lamp holder 2 is fastened to the housing 1. When the lamp holder 2 is fastened to the housing 1, the inside space of the housing 1 is divided into two parts, namely, the upper space defined within the housing 1 and the lamp holder 2 for holding electric apparatus, and the lower space defined within the lamp holder 2 and the bottom board 5.

Figure 5:
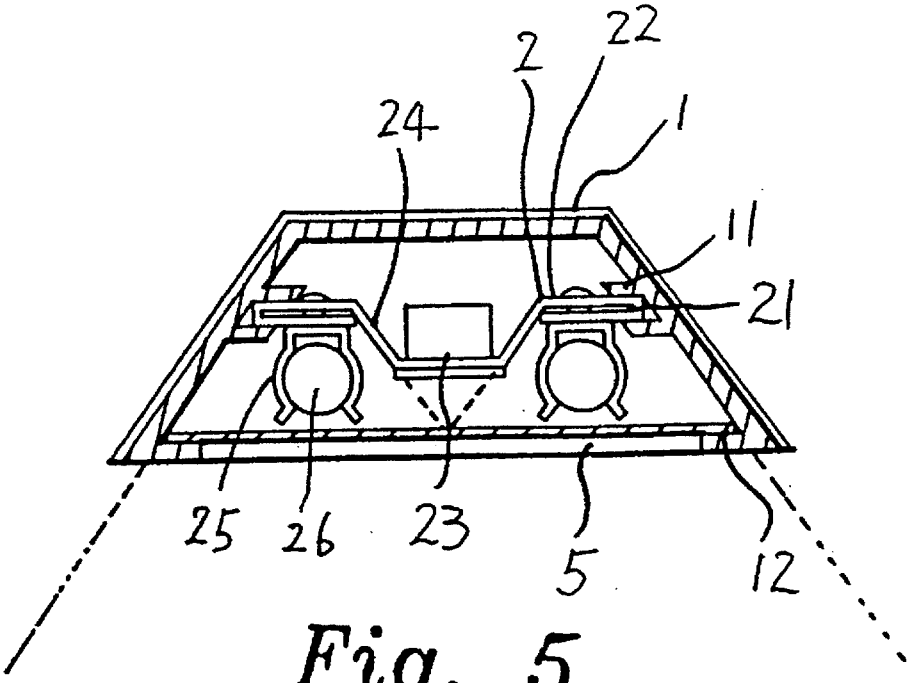
FIG. 5 is a cross sectional view of the lighting fixture of FIG. 4, showing the reflection of light.

Referring to FIG. 5 and FIG. 3 again, when lateral bearing walls 22 of the lamp holder 2 are fastened to the longitudinal upper tracks 11 of the housing 1 with the intermediate bearing wall 23 disposed at a lower elevation than the lateral bearing walls 22, two lamp tubes 26 are fastened to the lateral bearing walls 22 by clamps 25. Then, water sealing jackets 6 have a respective front receptacle 61 respectively covered the lamp tubes 26 at two opposite ends, permitting the contact pins 261 of each lamp tube 26 to be extended out of the water sealing jackets 6 and connected to a respective electric socket 62. The lamp holder 2 is preferably made of aluminum so that it can effectively reflect light and dissipate heat.

Figure 6:
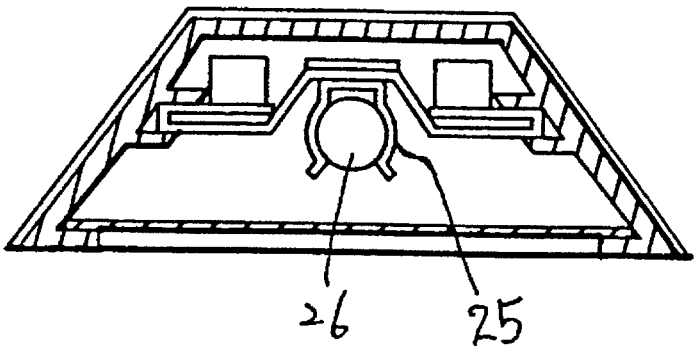
FIG. 6 is similar to FIG. 5, but showing the lamp holder turned upside down and a single lamp tube suspended from the intermediate bearing wall of the lamp holder.

Referring to FIG. 6, the lamp holder 2 may be fastened to the housing 1 with the intermediate bearing wall 23 disposed at a higher elevation than the lateral bearing walls 22 so that a single lamp tube 26 can be fastened to the intermediate bearing wall 23 by clamps 25.

Because the lamp holder 2 is made of hollow structure, when clamps 25 are fixed to the lateral bearing walls 22 or the intermediate bearing wall 23 by screws, the points of the screws do not extend to the outside. Because the housing 1 defines a downward open space in width gradually bigger toward the bottom and the lamp holder 2 has two sloping walls 24 to reflect light, light can be effectively reflected downwards for illumination.

What is claimed is:

1. A lighting fixture comprising:

an elongated housing having a uniform cross section shaped like a truncated cone, defining a downward open space in width gradually bigger toward the bottom, said housing comprising two longitudinal upper tracks and two longitudinal lower tracks bilaterally disposed on the inside and a plurality of vent holes on a top wall thereof;

a transparent water-proof bottom board fastened to said longitudinal lower tracks;

a lamp holder fastened to said longitudinal upper tracks to hold lamp tubes, said lamp holder made of hollow structure comprised of two flat, longitudinal, lateral bearing walls fitted into said longitudinal upper tracks for holding a respective lamp tube below said lamp holder, a flat, longitudinal, intermediate bearing wall for holding a lamp tube above said lamp holder, and two opposite sloping walls bilaterally connected between said lateral bearing walls and said intermediate bearing wall;

two end caps fastened to two opposite ends of said housing and matched with said transparent water-proof bottom board to enclose said downward open space;

water sealing jackets for respectively mounting on two opposite ends of each lamp tube being fastened to said lamp holder, each water sealing jacket having a receptacle at one end for receiving one lamp tube, and an electric socket at an opposite end for receiving the contact pins of the respective lamp tube and connecting them to an electric power circuit.

2. The lighting fixture of claim 1 wherein said lamp holder is fastened to said housing with said intermediate bearing wall disposed at a higher elevation than said lateral bearing walls for allowing a single lamp tube to be mounted on said intermediate bearing wall and disposed between said sloping walls.

3. The lighting fixture of claim 1 wherein said lamp holder is fastened to said housing with said intermediate bearing wall disposed at a lower elevation than said lateral bearing walls for allowing two lamp tubes to be mounted on said lateral bearing walls outside and disposed at a lower elevation than said lateral bearing walls.

4. The lighting fixture of claim 1 wherein the space defined within said housing and said bottom board is divided by said lamp holder into an upper chamber for holding electric apparatus, and a lower chamber.

* * * * *